US005884878A

United States Patent [19]

Eckhardt

[11] Patent Number: 5,884,878

[45] Date of Patent: Mar. 23, 1999

[54] DEVICE FOR RAPIDLY FILLING SANDBAGS

[76] Inventor: George W Eckhardt, 5855 Green Valley Cir., Suite 102, Culver City, Calif. 90230

[21] Appl. No.: 931,007

[22] Filed: Sep. 15, 1997

[51] Int. Cl.[6] ..... B65B 67/12

[52] U.S. Cl. ..... 248/95; 248/99

[58] Field of Search ..... 248/95, 97, 99; 211/10, 12; 220/23.83, 86.1, 654, 744

[56] References Cited

U.S. PATENT DOCUMENTS

| | | | |
|---|---|---|---|
| 176,555 | 4/1876 | Scholfield | 248/99 |
| 178,727 | 6/1876 | Brown et al. | 248/97 |
| 200,342 | 2/1878 | Relph | 248/99 |
| 861,007 | 7/1907 | Wilhelm | 248/97 |
| 1,088,633 | 2/1914 | Simmons et al. | 248/95 |
| 3,295,694 | 1/1967 | Nejezchles et al. | 248/99 |
| 4,312,531 | 1/1982 | Cross | 248/99 |
| 4,702,445 | 10/1987 | Ivory | 248/97 |
| 4,723,742 | 2/1988 | Krauss | 248/97 |
| 4,842,228 | 6/1989 | Kasper | 248/97 |
| 5,226,621 | 7/1993 | Skoff | 248/97 |
| 5,271,589 | 12/1993 | Belous | 248/99 |
| 5,397,085 | 3/1995 | Spagnolo | 248/97 |
| 5,406,777 | 4/1995 | Porto | 248/97 |

*Primary Examiner*—Leslie A. Braun
*Assistant Examiner*—Robert Lipcsik
*Attorney, Agent, or Firm*—Michael I. Kroll

[57] ABSTRACT

A device (10) for rapidly filling sandbags (12) comprising a tray (14) having a plurality of apertures (16) therethrough. A plurality of funnel pails (18) are provided. Each funnel pail (18) is insertable through one of the apertures (16) in the tray (14). A structure (20) is for retaining upper portions of the funnel pails (18) in the apertures (16) of the tray (14). A plurality of empty sandbags (12) can be completely placed over the funnel pails (18) when the tray (14) is inverted. The tray (14) is then turned right side up, with the empty sandbags (12) on the funnel pails (18) placed upon the ground (22) and then sand (24) is shoveled into the funnel pails (18) to fill up the sandbags (12).

7 Claims, 5 Drawing Sheets

7

Fig. 7
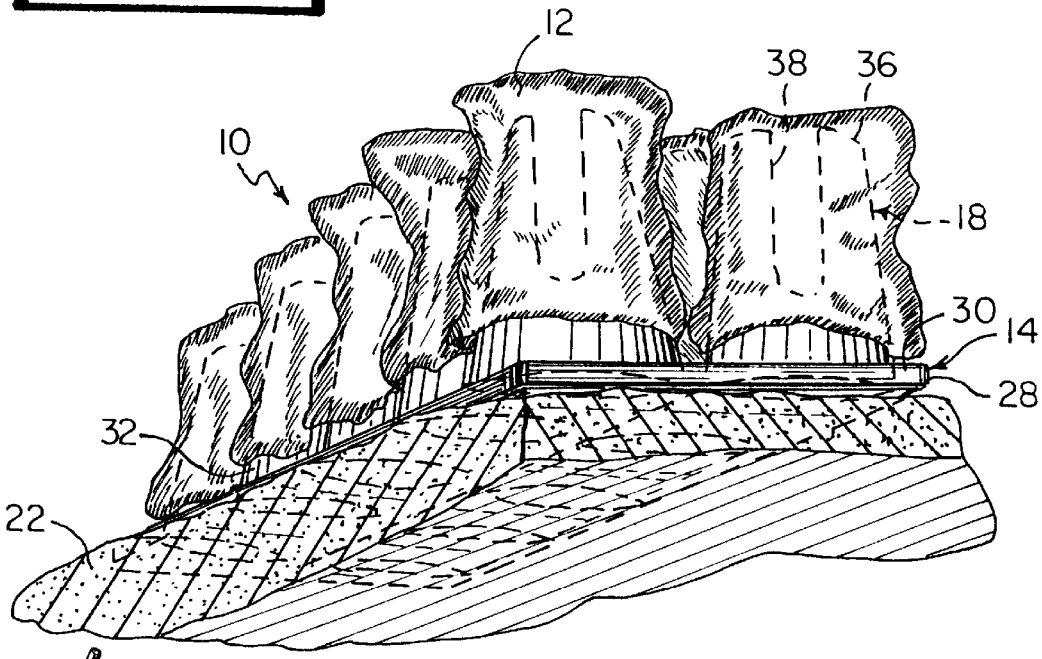
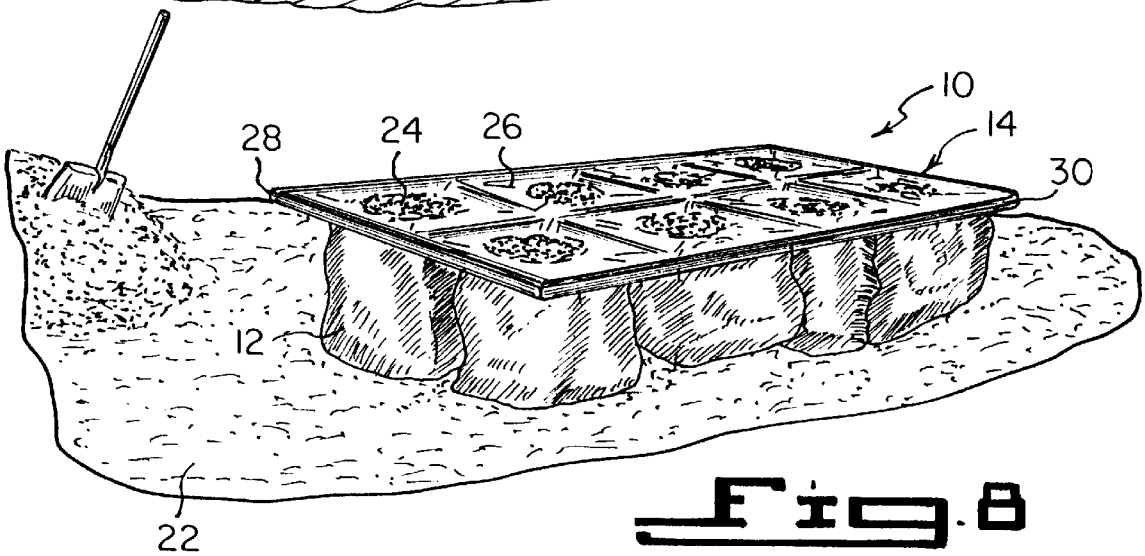
Fig. 8
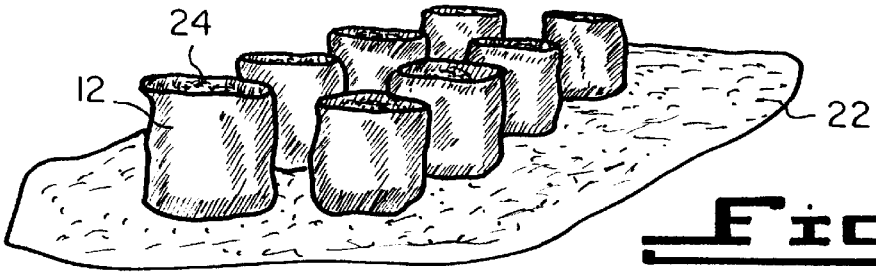
Fig. 9

DEVICE FOR RAPIDLY FILLING SANDBAGS

BACKGROUND OF THE INVENTION

1. Field of the Invention

The instant invention relates generally to bag support holders and more specifically it relates to a device for rapidly filling sandbags. The device has the ability to fill the sandbags at three times the normal manual rate. It also prevents over and under filling of the sandbags. The device will also reduce fatigue among volunteers.

2. Description of the Prior Art

Numerous bag support holders have been provided in prior art. For example, U.S. Pat. Nos. 178,727 to Brown et al.; 4,842,228 to Kasper; 5,226,621 to Skoff; 5,397,085 to Spagnolo and 5,406,777 to Porto all are illustrative of such prior art. While these units may be suitable for the particular purpose to which they address, they would not be as suitable for the purposes of the present invention as heretofore described.

Brown, John T.

Colbert, Joseph W.

Bag Holder

U.S. Pat. No. 178,727

The invention is a device for holding bags, by the aid of which they may be more easily and quickly filled with grain, flour, meal, or other material. The invention consists of two ratchet-toothed uprights, which face each other, and rise from opposite corners of the rear of a rectangular base. The uprights are bound together by a cross bar below the teeth, which run upward. A hopper slides upon the front surfaces of the uprights, against which it is held by flanges on the ends of two horizontal clips attached to its rear surface, which flanges rest on the rear surfaces of the uprights. The upper clip has on each side of its center an opening, in which is pivoted a detent, the upper ends of the detents serving as handles to release their points from the teeth of the uprights. To the upper surface of the lower clip is fixed a block, having attached to each side a spring, the free end of which presses against the detent on the same side below the pivot, and forces it between the teeth of the corresponding upright. To the lower part of the front of the hopper, hooks are fixed, on which the bag is hung when it is to be filled, its bottom resting on the base of the bag holder, and the outlet of the hopper projecting into its mouth.

Kasper, Brenda M.

Support for a Trash Bag and Method of Using such Support

U.S. Pat. No. 4,842,228

Disclosed is a device for holding a plastic trash bag in an open, upright position including a tubular liner member that is placed inside the trash bag to open the bag and provide support for holding the bag in an upright position. This liner member preferably is of a hollow, truncated, conical configuration with the bottom end being adjacent the closed end of the trash bag and being slightly greater in diameter than the opposed top end of the liner. A removeable cover is placed over the bottom end of the liner member after the liner member has been inserted into the trash bag. This cover includes a pair of opposed, hingedly mounted handles that move into a locking position to hold the assembly of the liner and cover together with the bag sandwiched therebetween. The device may be equipped with a lid that covers the open end.

Skoff, James

Covertible Collection Device and Work Table Combination

U.S. Pat. No. 5,226,621

A portable, convertible collection device and work table combination which includes a frame with a plurality of ribs defining a substantially rectangular interior with two distinct openings. Each opening is adapted to receive a bag supported by the ribs. A plurality of legs supporting the ribs extend adjacent a corner of the rectangular interior. A removable table, which is adapted to be supported by the ribs, includes a table top and a plurality of positioning studs attached to the bottom surface of the table top which are receivable in the rectangular interior to, position the table on the ribs. A removable funnel is adapted to be supported on the ribs, to direct material into the bags supported from the ribs.

Spagnola, Andrew J.

Sandbag Filling Aid

U.S. Pat. No. 5,397,085

A new and improved sandbag filling aid for supporting a sandbag in an upright position and providing a fill-chute to enable a single person to rapidly and efficiently fill sandbags during emergency situations. The sandbag filling aid comprising an upright tubular frame structure having a left and right parallel support columns, a first horizontal hoop member, and a second horizontal hoop member. A sandbag within the first hoop may be clamped in place by pivoting the second hoop downwardly until it contacts the sandbag. An arcuate fill-chute member extends upwardly and slightly outwardly from the second hoop member, such that when the second hoop member is positioned for clamping a sandbag, the chute will catch and direct hastily shovelled or thrown sand into the mouth of the sandbag.

Porto, Aldo

Grass Hopper Cart

U.S. Pat. No. 5,406,777

A grass hopper cart is provided, which consists of a cabinet and a structure within the cabinet for holding a standard paper bag in an opened stationary position. A hopper is placed into the cabinet above the holding structure, so that grass cuttings dumped into the hopper will enter the paper bag for proper disposal.

SUMMARY OF THE INVENTION

A primary object of the present invention is to provide a device for rapidly filling sandbags that will overcome the shortcomings of the prior art devices.

Another object is to provide a device for rapidly filling sandbags having the ability to fill the sandbags at three times the normal manual rate, whereby producing three times as many sandbags is a very important factor when racing against nature.

An additional object is to provide a device for rapidly filling sandbags that will prevent over and under filling of the sandbags, in which the uniformity created addresses a crucial problem when constructing water barracks.

A still additional object is to provide a device for rapidly filling sandbags that will reduce fatigue among volunteers, while also serving as the centerpiece for organizing an effective work plan for filling a maximum amount of bags with sand with the manpower available.

A further object is to provide a device for rapidly filling sandbags that is simple and easy to use, has no moving parts and is durable, storable, stackable and shipable.

A still further object is to provide a device for rapidly filling sandbags that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 7 is an inverted perspective view of the present invention upon the ground, taken in the direction of arrow 7 in FIG. 6, showing all of the empty bags placed over all of the funnel pails.

FIG. 8 is a perspective view, taken in the direction of arrow 8 in FIG. 1, of the present invention turned right side up upon the ground, showing all the bags filled with sand.

FIG. 9 is a perspective view showing the present invention removed from the bags filled with sand upon the ground.

Similar reference characters denote corresponding features consistently throughout the attached drawings.

DESCRIPTION OF THE PREFERRED EMBODIMENTS

Figure 1:
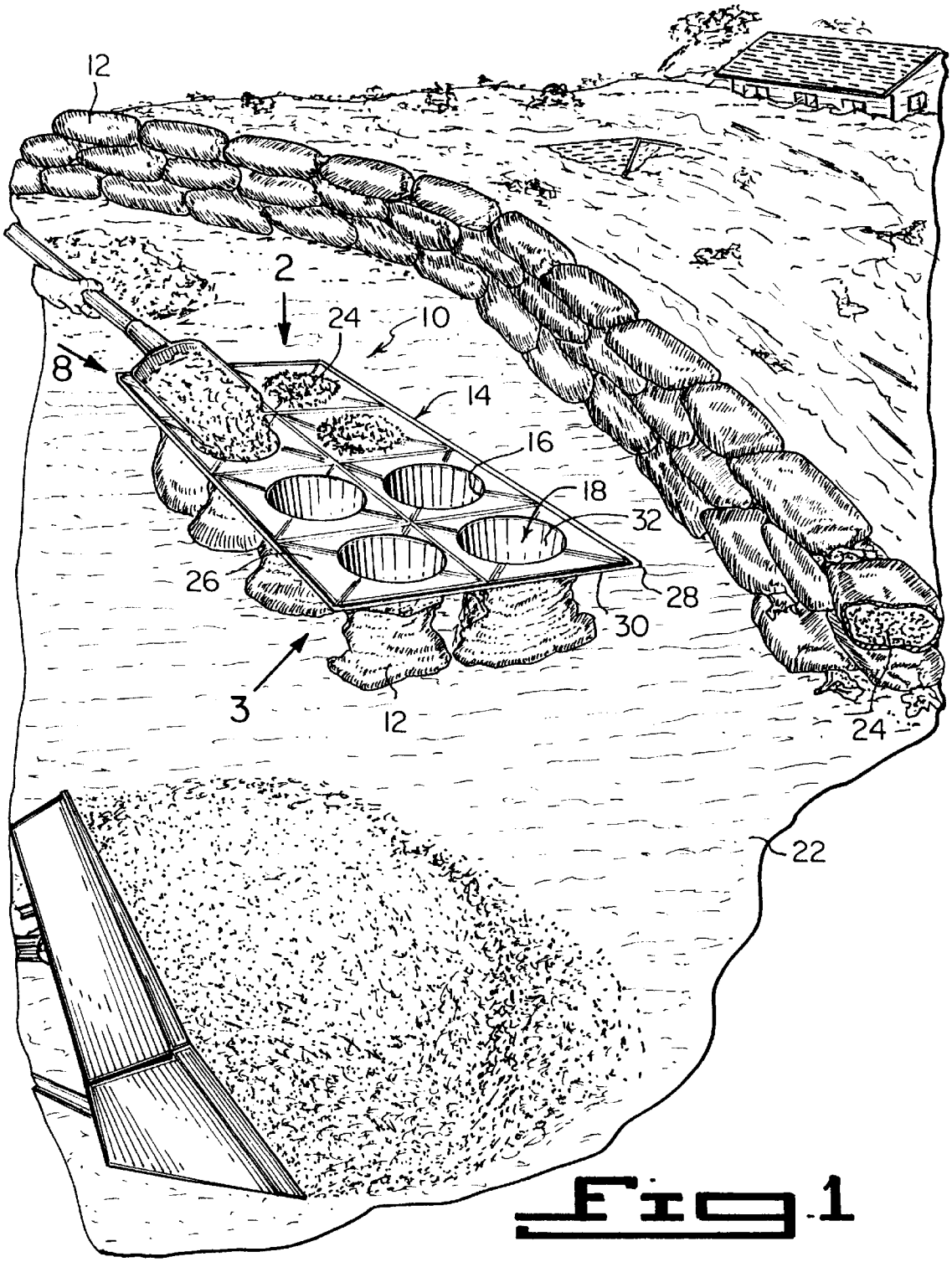
FIG. 1 is a perspective view of the present invention in use.
Figure 2:
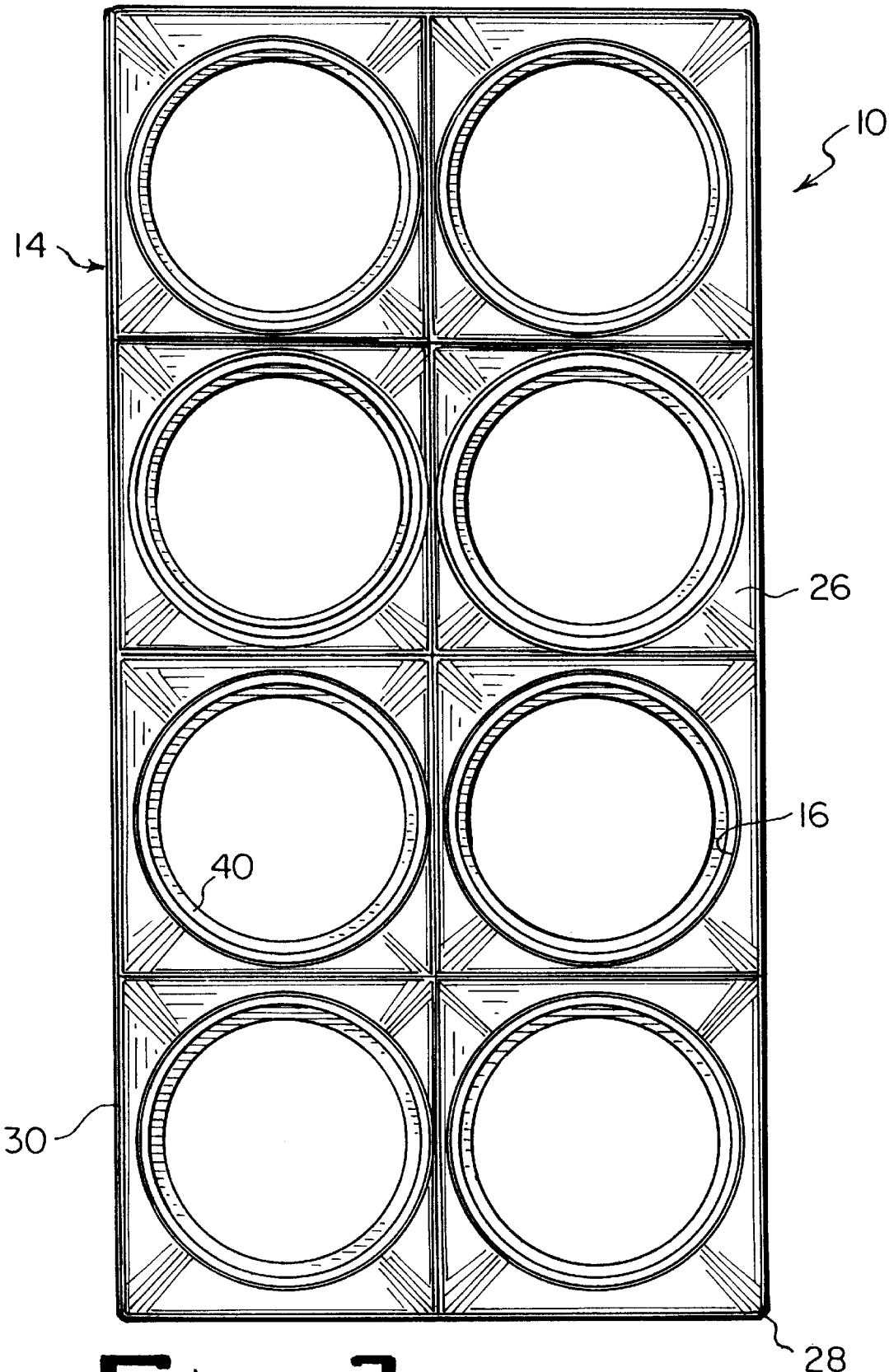
FIG. 2 is top plan view taken in the direction of arrow 2 in FIG. 1, of the tray with the funnel pails removed therefrom.
Figure 3:
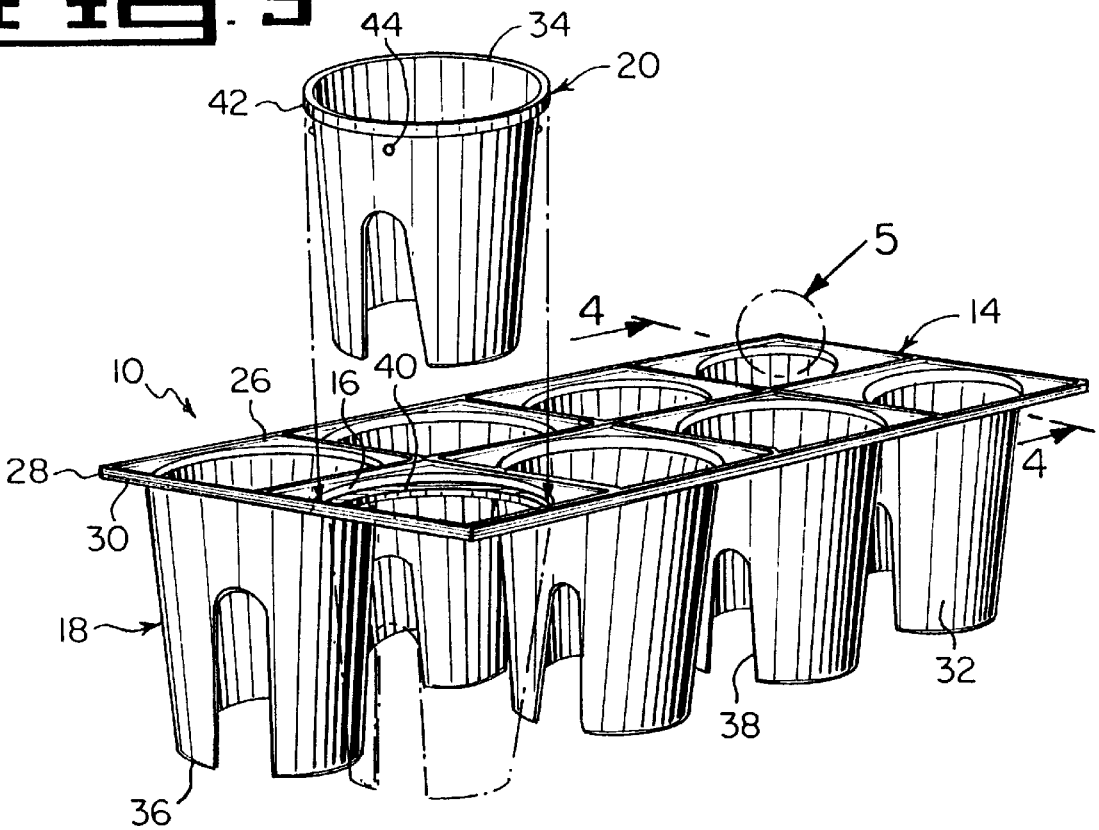
FIG. 3 is a perspective view of the present invention per se taken in the direction of arrow 3 in FIG. 1, showing one of the funnel pails ready to be inserted into the tray.

Turning now descriptively to the drawings, in which similar reference characters denote similar elements throughout the several views, FIGS. 1 through 8 illustrate the present invention being a device 10 for rapidly filling sandbags 12. With regard to the reference numerals used, the following numbering is used throughout the various drawing figures.

10 device
12 sandbag
14 tray of 10
16 aperture in 14
18 funnel pail of 10
20 retaining structure of 10
22 ground
24 sand
26 concaved surfaced fence on 14
28 rounded corner of 14
30 downwardly extending flange on 14
32 hollow truncated conical body of 18
34 open top end of 32
36 open bottom end of 32
38 cutout flute in 32
40 stepped annular seat in 16 of 20
42 top annular lip on 18 of 20
44 locking lug on 18 of 20
46 highly durable lightweight, sturdy material (plastic)

The device 10 comprises a tray 14 having a plurality of apertures 16 therethrough. A plurality of funnel pails 18 are provided. Each funnel pail 18 is insertable through one of the apertures 16 in the tray 14. A structure 20 is for retaining upper portions of the funnel pails 18 in the apertures 16 of the tray 14. A plurality of empty sandbags 12 can be completely placed over the funnel pails 18, when the tray 14 is inverted. The tray 14 is then turned right side up, with the empty sandbags 12 on the funnel pails 18 placed upon the ground 22, and then sand 24 is shoveled into the funnel pails 18 to fill up the sandbags 12.

The tray 14 includes a plurality of concaved surfaced fences 26. Each concaved surfaced fence 26 is about each aperture 16, to help guide the sand 24 into each respective funnel pail 18. Each corner 28 of the tray 14 is rounded to add strength and prevent chipping thereto. The tray 14 also includes all exterior edges having a downwardly extending flange 30 thereabout to facilitate gripping the tray 14, while adding extra strength overall to the tray 14.

Each funnel pail 18 is a hollow truncated conical body 32 having an open top end 34 and a smaller open bottom end 36 with two opposed cutout flutes 38 extending upwardly from the open bottom end 36. The sand 24 will pour out through the open bottom end 36 and the cutout flutes 38 into the respective empty sandbag 12.

The retaining structure 20 consists of a plurality of stepped annular seats 40. Each stepped annular seat 40 is located within each aperture 16 in the tray 14. Each funnel pail 18 has a top annular lip 42 thereabout. The top annular lip 42 can engage with one stepped annular seat 40, when the funnel pail 18 is inserted through the respective aperture 16 in the tray 14. Each funnel pail 18 has a plurality of locking lugs 44 radially positioned thereabout under the top annular lip 42. When each funnel pail 18 is inserted through each aperture 16 in the tray 14, the locking lugs 44 will snap into place at the bottom of the tray 14, to hold each funnel pail 18 to the tray 14 when the tray 14 is inverted.

Figure 4:
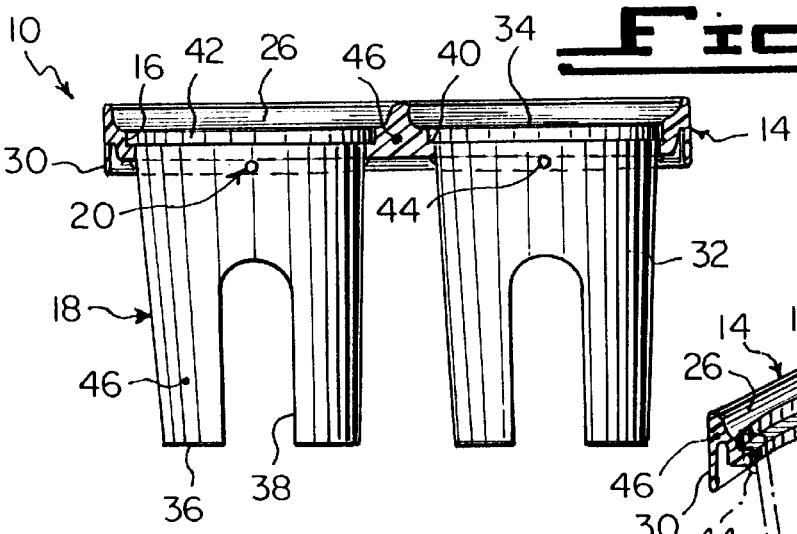
FIG. 4 is a cross sectional view taken along line 4—4 in FIG. 3, showing the tray in section and the funnel pails in elevation.
Figure 5:
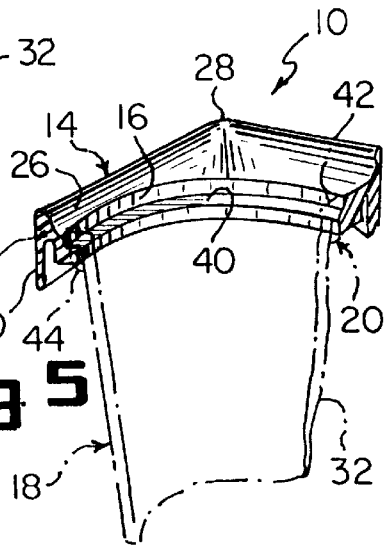
FIG. 5 is an enlarged perspective view of an area of the tray as indicated by arrow 5 in FIG. 3, with a portion of the funnel pail shown in phantom.
Figure 6:
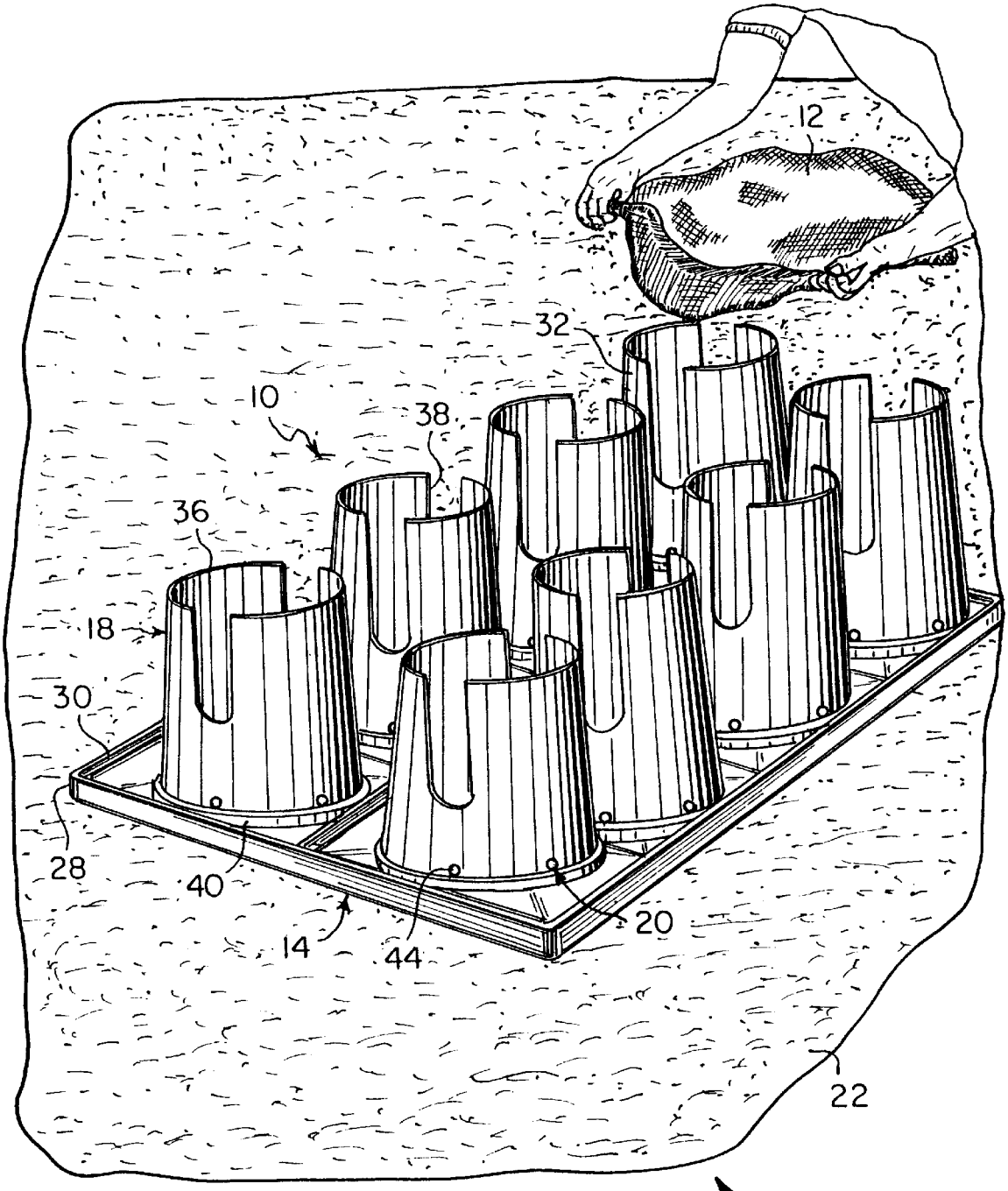
FIG. 6 is an inverted perspective view of the present invention upon the ground, with an empty bag ready to be placed over one of the funnel pails.

As shown in FIGS. 4 and 5, the tray 14 is fabricated out of a highly durable, lightweight, sturdy material 46, which is plastic. Each of the funnel pails 18 is fabricated out of the same highly durable, lightweight, sturdy plastic material 46.

OPERATION OF THE INVENTION

To use the device 10, the following steps should be taken:

1. Insert all of the funnel pails 18 through all of the apertures 16 in the tray 14, so that the top annular lips 42 will engage with the stepped annular seats 40, while the locking lugs 44 will snap into place at the bottom of the tray 14 (see FIG. 3).
2. Invert the tray 14 on the ground 22, so that the funnel pails 18 face skyward (see FIG. 6).
3. Place each empty sandbag 12 over each funnel pail 18, making sure to fit the sandbags 12 all the way onto the funnel pails 18 until the bottom of each sandbag 12 reaches the open bottom end 36, so as to insure that all of the sandbags 12 will be filled from the bottom up (see FIG. 7).
4. Turn the tray 14 right side up, with the empty sandbags 12 on the funnel pails 18 placed upon the ground (see FIG. 1).
5. Shovel the sand 24 into the funnel pails 18 to fill up all of the sandbags 12 (see FIG. 8).
6. Wiggle the tray 14 slightly while lifting, leaving the sandbags 12 filled with exactly the same amount of sand 24 on the ground 22 and ready for tying and transport (see FIG. 9).

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A device for rapidly filling sandbags comprising:

a) a tray having a plurality of apertures therethrough, each aperture having an annular stepped seat and a concave surface fence surrounding said aperture above said seat;

b) a plurality of funnel pails, each said funnel pail being removably inserted through one of said apertures in said tray, each funnel pail including a hollow truncated conical body having an open top end and a smaller open bottom end with two opposed cutout flutes extending upwardly from said open bottom end for allowing sand to pour out through said flutes, and each funnel pail having an annular lip surrounding said open top end for engaging said stepped seat;

c) means for retaining said funnel pails in said apertures of said tray when said device is sitting on the ground with said funnel pails extending downwardly in said apertures comprising locking lugs radially positioned about said pails adjacent said annular lips; and d) an empty sandbag covering each of said funnel pails with the openings of said sandbags adjacent the open top ends of said funnel pails, permitting sand to be poured into said apertures and flowing into said sandbags through the open top ends and flutes of said funnel pails, said concave surface fence in each said aperture helping guide the sand into each funnel pail.

2. A device for rapidly filling sandbags as recited in claim 1, wherein each corner of said tray is rounded to add strength and prevent chipping thereto.

3. A device for rapidly filling sandbags as recited in claim 1, wherein said tray includes all exterior edges having a downwardly extending flange thereabout to facilitate gripping said tray, while adding extra strength overall to said tray.

4. A device for rapidly filling sandbags as recited in claim 1, wherein said tray is fabricated out of a highly durable, lightweight, sturdy material.

5. A device for rapidly filling sandbags as recited in claim 4, wherein said highly durable, lightweight, sturdy material is plastic.

6. A device for rapidly filling sandbags as recited in claim 1, wherein each of said funnel pails is fabricated out of a highly durable, lightweight, sturdy material.

7. A device for rapidly filling sandbags as recited in claim 6, wherein said highly durable, lightweight, sturdy material is plastic.

* * * * *